US010280720B2

(12) United States Patent
Zhao et al.

(10) Patent No.: US 10,280,720 B2
(45) Date of Patent: May 7, 2019

(54) SUBMERSIBLE RECIPROCATING OIL WELL PUMP UNIT

(71) Applicants: Xihuan Zhao, Tianjin (CN); Ruiqi Zhang, Tianjin (CN)

(72) Inventors: Xihuan Zhao, Tianjin (CN); Ruiqi Zhang, Tianjin (CN)

( * ) Notice: Subject to any disclaimer, the term of this patent is extended or adjusted under 35 U.S.C. 154(b) by 220 days.

(21) Appl. No.: 15/453,915

(22) Filed: Mar. 9, 2017

(65) Prior Publication Data

US 2017/0175502 A1 Jun. 22, 2017

Related U.S. Application Data

(63) Continuation-in-part of application No. PCT/CN2015/000631, filed on Sep. 7, 2015.

(30) Foreign Application Priority Data

Sep. 9, 2014 (WO) ..... PCT/CN2014/000831

(51) Int. Cl.
*F04B 47/06* (2006.01)
*F04B 17/03* (2006.01)
*E21B 43/12* (2006.01)

(52) U.S. Cl.
CPC ..... *E21B 43/128* (2013.01); *F04B 17/03* (2013.01); *F04B 47/06* (2013.01)

(58) Field of Classification Search
CPC .... E21B 43/121; E21B 43/126; E21B 43/127; E21B 43/128; F04B 17/03; F04B 53/18; F04B 53/144; F04B 47/06
See application file for complete search history.

(56) References Cited

U.S. PATENT DOCUMENTS 7,780,428 B2 * 8/2010 Zhao ..... E21B 17/206 166/106
2014/0105759 A1 * 4/2014 Henry ..... F04B 47/02 417/53
2017/0241246 A1 * 8/2017 Harnsberger ..... E21B 41/00

* cited by examiner

*Primary Examiner* — Michael R Wills, III
(74) *Attorney, Agent, or Firm* — Matthias Scholl P.C.; Matthias Scholl

(57) ABSTRACT

A submersible reciprocating oil well pump unit, including: a control cabinet, a rotary type submersible motor, a borehole torque reversing device, a borehole reciprocating pump, a submersible cable, a first joint, a second joint, and an oil pipe. The control cabinet is disposed at wellhead and connected to the rotary type submersible motor submerged in a downhole sleeve via the submersible cable. The motor shaft is connected to one end of the screw rod of the screw pair of the borehole torque reversing device via the first joint. One end of the driving rod is connected to a push-pull rod of the borehole reciprocating pump via the second joint. The oil outlet is connected to the oil pipe. The borehole torque reversing device is adapted to drive the control cabinet to commutate automatically according to set loading values.

6 Claims, 2 Drawing Sheets

SUBMERSIBLE RECIPROCATING OIL WELL PUMP UNIT

CROSS-REFERENCE TO RELATED APPLICATIONS

This application is a continuation-in-part of International Patent Application No. PCT/CN2015/000631 with an international filing date of Sep. 7, 2015, designating the United States, now pending, and further claims foreign priority benefits to International Patent Application No. PCT/CN2014/000831 filed Sep. 9, 2014. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a submersible reciprocating oil well pump unit comprising a borehole torque reversing device.

Description of the Related Art

A typical oil well pump unit adopts a land-type driving and torque reversing device to convert rotary force output into a linear reciprocating force by a land-type rotary motor, and then employs a long pumping rod to transmit the linear reciprocating force to a downhole oil well pump. However, the conversion and transmission process is complex and inefficient in rotary to linear force transmission.

In addition, the oil well pump assembly is not applicable in such well conditions as multiple inflection points, large slope, and high lift. Besides, the oil well pump assembly is bulky, occupies large ground area, and has a relatively frequent maintenance intervals and short service life.

SUMMARY OF THE INVENTION

In view of the above-described problems, it is one objective of the invention to provide a submersible reciprocating oil well pump unit comprising a borehole torque reversing device. The oil well pump assembly is adapted to convert a rotary force produced by the rotary submersible motor into a linear reciprocating force via the borehole torque reversing device, so as to directly drive the oil well pump in the well in the absence of a long pumping rod.

To achieve the above objective, in accordance with one embodiment of the invention, there is provided a submersible reciprocating oil well pump unit comprising a borehole torque reversing device. The submersible reciprocating oil well pump unit comprises: a control cabinet, a borehole torque reversing device, a borehole reciprocating pump, a submersible cable, a first joint, a second joint, and an oil pipe. The rotary type submersible motor comprises a motor shaft. The borehole torque reversing device comprises: a driving rod and a screw pair comprising a screw rod and a guide nut. The borehole reciprocating pump comprises: a push-pull rod and an oil outlet. The control cabinet is disposed at a wellhead and connected to the rotary type submersible motor submerged in a downhole sleeve via the submersible cable. The motor shaft is connected to one end of the screw rod of the screw pair of the borehole torque reversing device via the first joint. The driving rod is a reciprocating unit, and one end of the driving rod connected to the guide nut of the screw pair is connected to a push-pull rod of the borehole reciprocating pump via the second joint. The oil outlet of the borehole reciprocating pump is connected to the oil pipe. The borehole torque reversing device is of a reciprocating loading balance type and enables the control cabinet to commutate automatically according to set loading values. The rotary type submersible motor is an asynchronous start permanent magnet synchronous submersible motor.

In a class of this embodiment, the rotary type submersible motor comprises: a motor housing, a stator, a rotor assembly, and a protector. The rotor assembly is formed by a permanent magnet steel rotor, a cage rotor, and a rotor bearing. The permanent magnet steel rotor and the cage rotor are spaced and supported by the rotor bearing.

In a class of this embodiment, the borehole torque reversing device comprises: a cavity, a housing, a screw pair, and a driving rod. A lower oil storing capsule unit and an upper oil storing capsule unit are disposed on two ends of the borehole torque reversing device and are respectively in tight connection with the housing of the borehole torque reversing device. An upstroke compression spring and a downstroke compression spring are disposed on two ends of the driving rod.

In a class of this embodiment, a capsule body of the lower oil storing capsule unit disposed on a lower end of the borehole torque reversing device is an elastomer in a structure of a cylinder. Two ends of the lower oil storing capsule unit are closely connected to the housing of the borehole torque reversing device to form an outer cavity of the lower oil storing capsule unit and an inner cavity of the lower oil storing capsule unit. The outer cavity of the lower oil storing capsule unit communicates with a well liquid outside an outer wall of the housing of the borehole torque reversing device. The inner cavity of the lower oil storing capsule unit communicates with the cavity of the borehole torque reversing device and is filled with a lubricant.

In a class of this embodiment, a capsule body of the upper oil storing capsule unit disposed on an upper end of the borehole torque reversing device is an elastomer in a structure of a cylinder. Two ends of the upper oil storing capsule unit are closely connected to the housing of the borehole torque reversing device to form an outer cavity of the upper oil storing capsule unit and an inner cavity of the upper oil storing capsule unit. The outer cavity of the upper oil storing capsule unit communicates with a well liquid outside an outer wall of the housing of the borehole torque reversing device. The inner cavity of the upper oil storing capsule unit communicates with the cavity of the borehole torque reversing device and is filled with a lubricant.

In a class of this embodiment, the downstroke compression spring and the upstroke compression spring are disposed on two ends of the driving rod of the borehole torque reversing device; and elastic loads of the downstroke compression spring and the upstroke compression spring enables the driving rod to bear same loads at a downstroke terminal and an upstroke terminal, whereby realizing timely commutation by the control cabinet according to set loading values.

Advantages of the submersible reciprocating oil well pump unit comprising the borehole torque reversing device according to embodiments of the invention are summarized as follows:

The submersible reciprocating oil well pump unit of the invention contains no long rod can reliably and effectively adapt to such well conditions as multiple infection points, large slope, and high lift. As the power source, the rotary type asynchronous start permanent magnet synchronous submersible motor of the invention has larger output power and higher efficiency than the linear type submersible motor, and better starting performance and higher energy targets than conventional rotary type submersible motors or permanent magnet motors. Two ends of the reciprocating loading balance type borehole torque reversing device are provided with the compression springs to cushion the shock every time the driving rod reaches the upstroke terminal and the downstroke terminal and make the loads exerted on the driving rod at the upstroke terminal and the downstroke terminal equivalent. It is possible for the control cabinet to realize commutation in the absence of sensor, therefore improving the reliability. The arrangement of the oil storing capsule units at the two ends of the borehole torque reversing device keeps the pressure balance in and outside the cavities when the driving rod quickly reciprocates and oil capacities of an upper part and a lower part of the cavity of the borehole torque reversing device sharply change, ensuring the reliability of the sealing performance of the inner cavity of the borehole torque reversing device. Thus, the device of the invention is adaptable to different requirements on lift and displacement of most oil wells, and the long term operation of the device is reliable. The device of the invention has appropriate structure, relatively low production cost, and high relatively high operation reliability.

BRIEF DESCRIPTION OF THE DRAWINGS

The invention is described hereinbelow with reference to the accompanying drawings, in which.

Figure 1:
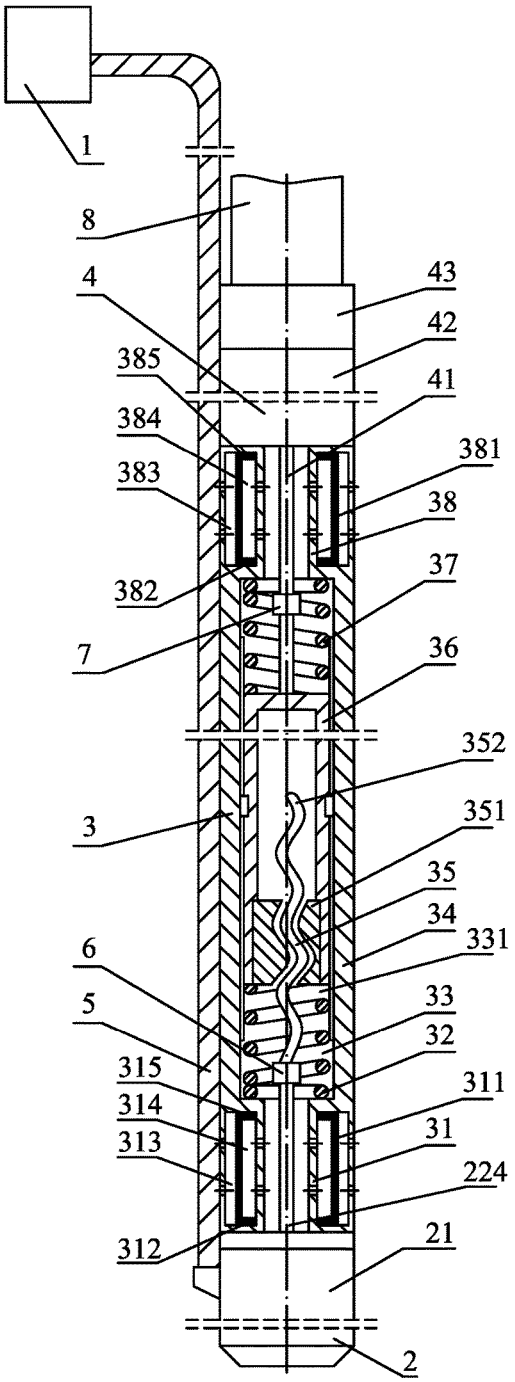
FIG. 1 is a longitudinal section view of a submersible reciprocating oil well pump unit comprising a borehole torque reversing device in accordance with one embodiment of the invention.
Figure 2:
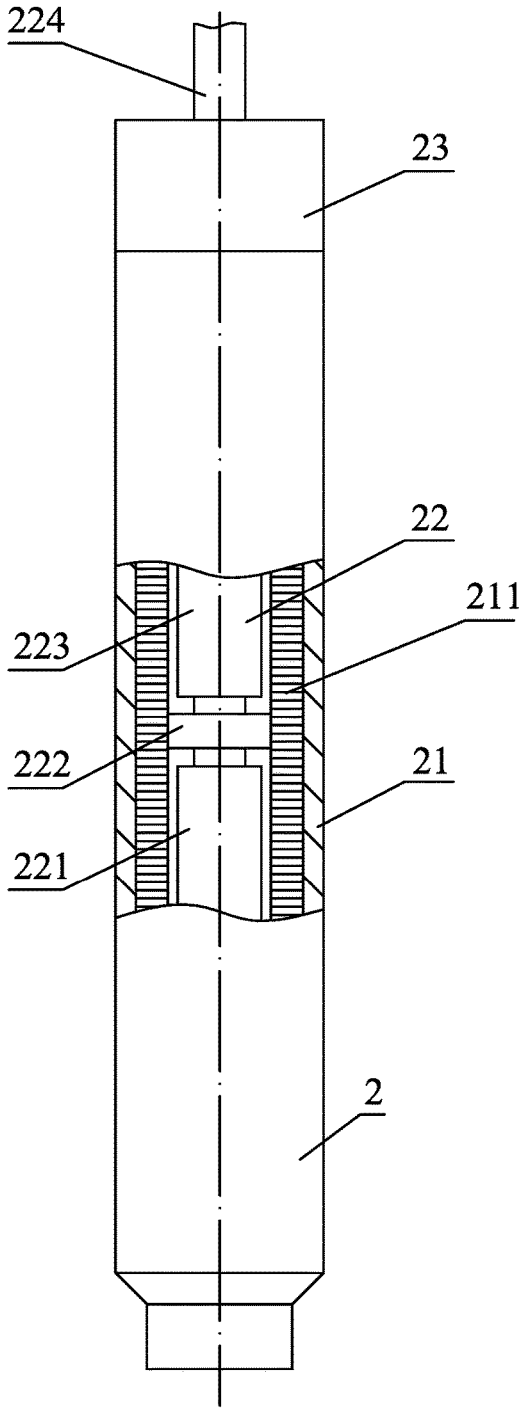
FIG. 2 is a longitudinal section view of a rotary type submersible motor comprising a protector in accordance with one embodiment of the invention.

In the drawings, the following numbers are used: 1. Control cabinet; 2. Rotary type submersible motor; 21. Motor housing; 211. Stator of motor; 22. Rotor assembly of motor; 221. Permanent magnet steel rotor; 222. Rotor bearing; 223. Cage rotor; 224. Motor shaft; 23. Protector of motor; 3. Borehole torque reversing device; 31. Lower oil storing capsule unit; 311. Body of lower oil storing capsule unit; 312. Lower end of lower oil storing capsule unit; 313. Outer cavity of lower oil storing capsule unit; 314. Inner cavity of lower oil storing capsule unit; 315. Upper end of lower oil storing capsule unit; 32. Downstroke compression spring; 33. Cavity of driving-converting device; 331. Lubricant; 34. Housing of driving-converting device; 35. Screw pair; 351. Guide nut; 352. Screw rod; 36. Driving rod; 37. Upstroke compression spring; 38. Upper oil storing capsule unit; 381. Body of upper oil storing capsule unit; 382. Lower end of upper oil storing capsule unit; 383. Outer cavity of upper oil storing capsule unit; 384. Inner cavity of upper oil storing capsule unit; 385. Upper end of upper oil storing capsule unit; 4. Borehole reciprocating pump; 41. Push-pull rod of pump; 42. Pump housing; 43. Oil outlet of pump; 5. Submersible cable; 6. First joint; 7. Second joint; and 8. Oil pipe.

DETAILED DESCRIPTION OF THE EMBODIMENTS

For further illustrating the invention, experiments detailing a submersible reciprocating oil well pump unit comprising a borehole torque reversing device are described below. It should be noted that the following examples are intended to describe and not to limit the invention.

One embodiment of the invention introduces a rotary submersible motor possessing excellent starting performance. A reciprocating loading balance type borehole torque reversing device converts the rotary force into the linear reciprocating force so as to enable the control cabinet to commutate automatically in accordance with the preset loading values (in the absence of sensors), and with the coordination of a set of reliable sealing systems, the oil well pump in the well is directly driven in the absence of the pumping rod.

FIG. 1 is a longitudinal section view of a submersible reciprocating oil well pump unit comprising a borehole torque reversing device. As shown in FIG. 1, the submersible reciprocating oil well pump unit comprising the borehole torque reversing device comprises an uphole control cabinet 1 adapted for automatic commutation in accordance with preset frequencies and load values. The control cabinet 1 is connected to an asynchronous start permanent magnet synchronous submersible motor 2 via a submersible cable 5.

The asynchronous start permanent magnet synchronous submersible motor 2 is a rotary type submersible motor which is designed based on a structure of the conventional rotary type submersible motor. The rotor assembly 22 of the motor is formed primarily by a permanent magnet steel rotor 221, and a cage rotor 223 is properly configured. The permanent magnet steel rotor 221 and the cage rotor 223 are spaced and supported by a rotor bearing 222.

The borehole torque reversing device 3 is a reciprocating loading balance type and comprises a screw pair 35 and a driving rod 36 disposed in a housing 34 of the borehole torque reversing device 3. The driving rod 36 is connected to a guide nut 351. A screw rod 352 drives the guide nut 351 when being rotated to the left or the right, so that reciprocating movement of the irrotational driving rod 36 is produced in an axial direction. A lower end of the driving rod 36 is provided with a downstroke compression spring 32, and an upper end of the driving rod 36 is provided with an upstroke compression spring 37. Besides, it is preset that a resultant force of a loading force produced by the downstroke compression spring 32 and a simultaneous loading force of the borehole reciprocating pump 4 exerted on the driving rod 36 at a downstroke terminal is equal to a resultant force a loading force produced by the upstroke compression spring 37 and a simultaneous loading force of the borehole reciprocating pump exerted on the driving rod at an upstroke terminal 4. One end of the screw rod 352 is connected to a motor shaft 224 of the submersible motor via a first joint 6, and one end of the driving rod 36 is connected to a push-pull rod 41 of the borehole reciprocating pump via a second joint 7.

One end of the housing 34 of the borehole torque reversing device 3 is connected to a pump housing 42 of the oil well pump, and the other end of the housing 34 of the borehole torque reversing device 3 is tightly connected to a motor housing 21.

An upper oil storing capsule unit 38 and a lower oil storing capsule unit 31 are respectively disposed on two ends of the reciprocating loading balance type borehole torque reversing device 3. Bodies of the upper oil storing capsule unit 38 and the lower oil storing capsule unit 31 are both elastomers in cylinder structures. A lower end 312 and an upper end 315 of the lower oil storing capsule unit 31 are respectively in tight connection with the housing 34 of the borehole torque reversing device 3 to form an outer cavity 313 and an inner cavity 314 of the lower oil storing capsule unit 31. A lower end 382 and an upper end 385 of the upper oil storing capsule unit 38 are respectively in tight connection with the housing 34 of the borehole torque reversing device 3 to form an outer cavity 383 and an inner cavity 384 of the upper oil storing capsule unit 31. The outer cavity 313 of the lower oil storing capsule unit 31 and the outer cavity 383 of the upper oil storing capsule unit 38 communicate with a well liquid outside the housing 34 of the borehole torque reversing device 3. The inner cavity 314 of the lower oil storing capsule unit 31 and the inner cavity 384 of the upper oil storing capsule unit 38 communicate with the cavity 33 of the borehole torque reversing device 3 and are filled with a lubricant 331. It is preset that oil throughputs of the inner cavity of the upper oil storing capsule unit and the inner cavity of the lower oil storing capsule unit match with variations in oil capacities of an upper part and a lower part of the cavity 33 of the borehole torque reversing device 3 to make a pressure of the lubricant 331 in the cavity 33 of the borehole torque reversing device 3 keep in balance with a pressure of the well liquid outside the cavity of the borehole torque reversing device 3, thus ensuring the reliability of the sealing property of the borehole torque reversing device 3.

The borehole reciprocating pump 4 comprises: a pump housing 42, the push-pull rod 41, and an oil outlet 43. The oil outlet 43 of the borehole reciprocating pump 4 is connected to an oil pipe 8.

An upper end of the housing 32 of the driving-converting device 3 is connected to the pump housing 42, and a lower end of the housing 32 of the driving-converting device 3 is connected to the motor housing 21.

The oil well pump 4, the reciprocating loading balance type driving-converting device 3, and the rotary type asynchronous start permanent magnet synchronous submersible motor 2 provided with a protector are suspended by the oil pipe 8 in the well sleeve as a whole, and thus forming a submersible type non-rod-driving downhole well pump mechanism.

Working principle of the submersible reciprocating oil well pump unit comprising the borehole torque reversing device is as follows:

The uphole control cabinet 1 controls the operation of the c. According to the specification of the pump assembly and different well conditions, commutation frequencies, frequencies, and loading values are preset. When the borehole submersible reciprocating oil well pump unit of the invention is electrically connected to a power supply. Current passes to the asynchronous start permanent magnet synchronous submersible motor 2 via the submersible cable 5. A motor shaft 22 of the asynchronous start permanent magnet synchronous submersible motor 2 rotates towards the left and the right alternately in accordance with the preset rotational speed and frequency along with the screw rod 352 of the reciprocating loading balance type borehole torque reversing device 3. In the meanwhile, the driving rod 36 connected to the guide nut 351 is driven by the operated screw rod 352 to reciprocate linearly in the axial direction along with the push-pull rod 41 of the oil well pump 4. The upstroke compression spring 37 and the downstroke compression spring 32 are appropriately configured to make the loads exerted on the motor at the upstroke terminal and the downstroke terminal satisfy the commutation condition of the control cabinet, thus ensuring the fluent operation of the commutation. The upper oil storing capsule unit 38 and the lower oil storing capsule unit 31 accumulate and release the lubricant to realize pressure balances in and outside the cavities during operation. The linear reciprocating motion allows the oil well pump to lift the well oil to uphole along the oil pipe 8. The current for starting the submersible reciprocating oil well pump unit is small, and the energy target is high.

Compared with the oil well pump assembly actuated from the ground surface, due that both the motor and the driving device are arranged downhole and in direct transmission connection with the oil well pump, the submersible reciprocating oil well pump unit comprising the borehole torque reversing device of the invention does not require a long rod for transmission, the efficiency is high and the energy-saving effect is obvious. Besides, the submersible reciprocating oil well pump unit is adaptable to well conditions including multiple infection points, large slope, and high lift, and the maintenance interval of the invention is long. Compared to the linear submersible motor actuated oil well pump assembly, the submersible reciprocating oil well pump unit of the invention adopts asynchronous start permanent magnet synchronous submersible motor which is an improvement based on the structure of the typical rotary type submersible motor and provides the driving-converting device that has reliable sealing system and reciprocating loading balance to realize the commutation of the control cabinet in accordance with preset loading values, thus ensuring high reliability and high power of the operation. The lift and the displacement are able to satisfy the targets required by most wells.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A submersible reciprocating oil well pump unit, comprising:

A) a control cabinet;

B) a rotary type submersible motor, the rotary type submersible motor comprising a motor shaft;

C) a borehole torque reversing device, the borehole torque reversing device comprising: a driving rod and a screw pair comprising a screw rod and a guide nut;

D) a borehole reciprocating pump, the borehole reciprocating pump comprising: a push-pull rod and an oil outlet;

E) a submersible cable;

F) a first joint;

G) a second joint; and

H) an oil pipe;

wherein the control cabinet is disposed at a wellhead and connected to the rotary type submersible motor submerged in a downhole sleeve via the submersible cable;

the motor shaft is connected to one end of the screw rod of the screw pair of the borehole torque reversing device via the first joint; the driving rod is a reciprocating unit, and one end of the driving rod connected to the guide nut of the screw pair is connected to the push-pull rod of the borehole reciprocating pump via the second joint; the oil outlet of the borehole reciprocating pump is connected to the oil pipe; and the borehole torque reversing device is of a reciprocating loading balance type and is adapted to drive the control cabinet to commutate automatically according to set loading values; and the rotary type submersible motor is an asynchronous start permanent magnet synchronous submersible motor.

2. The submersible reciprocating oil well pump unit of claim 1, wherein the rotary type submersible motor comprises: a motor housing, a stator, a rotor assembly, and a protector; the rotor assembly is formed by a permanent magnet steel rotor, a cage rotor, and a rotor bearing; and the permanent magnet steel rotor and the cage rotor are spaced and supported by the rotor bearing.

3. The submersible reciprocating oil well pump unit of claim 1, wherein the borehole torque reversing device comprises: a cavity, a housing, the screw pair, and the driving rod; a lower oil storing capsule unit and an upper oil storing capsule unit are disposed on two ends of the borehole torque reversing device and are respectively in tight connection with the housing of the borehole torque reversing device; and an upstroke compression spring and a downstroke compression spring are disposed on two ends of the driving rod.

4. The submersible reciprocating oil well pump unit of claim 3, wherein a capsule body of the lower oil storing capsule unit disposed on a lower end of the borehole torque reversing device is an elastomer in a structure of a cylinder; two ends of the lower oil storing capsule unit are closely connected to the housing of the borehole torque reversing device to form an outer cavity of the lower oil storing capsule unit and an inner cavity of the lower oil storing capsule unit;

the outer cavity of the lower oil storing capsule unit communicates with a well liquid outside an outer wall of the housing of the borehole torque reversing device; and the inner cavity of the lower oil storing capsule unit communicates with the cavity of the borehole torque reversing device and is filled with a lubricant.

5. The submersible reciprocating oil well pump unit of claim 3, wherein a capsule body of the upper oil storing capsule unit disposed on an upper end of the borehole torque reversing device is an elastomer in a structure of a cylinder; two ends of the upper oil storing capsule unit are closely connected to the housing of the borehole torque reversing device to form an outer cavity of the upper oil storing capsule unit and an inner cavity of the upper oil storing capsule unit;

the outer cavity of the upper oil storing capsule unit communicates with a well liquid outside an outer wall of the housing of the borehole torque reversing device; and the inner cavity of the upper oil storing capsule unit communicates with the cavity of the borehole torque reversing device and is filled with a lubricant.

6. The submersible reciprocating oil well pump unit of claim 5, wherein the downstroke compression spring and the upstroke compression spring are disposed on two ends of the driving rod of the borehole torque reversing device; and elastic loads of the downstroke compression spring and the upstroke compression spring make a first load exerted on the driving rod at a downstroke terminal equivalent to a second load exerted on the driving rod at an upstroke terminal to realize timely commutation of the control cabinet according to the set loading values.

* * * * *